US005487476A

United States Patent [19]

Barfield

[11] Patent Number: 5,487,476

[45] Date of Patent: Jan. 30, 1996

[54] ORNAMENTAL TREE FLOWER POT DISPLAYS

[76] Inventor: Marvin W. Barfield, Rte. 2, Box 805, Rockville, Va. 23146

[21] Appl. No.: 219,280

[22] Filed: Mar. 29, 1994

[51] Int. Cl.[6] ..... A47F 5/00

[52] U.S. Cl. ..... 211/71; D6/405; 211/205; 248/159; 47/39

[58] Field of Search ..... 211/205, 196, 211/71; 248/159; D6/405, 558; 47/39, 39 C

[56] References Cited

U.S. PATENT DOCUMENTS

| | | | |
|---|---|---|---|
| D. 193,438 | 8/1962 | Holt | D6/405 |
| D. 298,460 | 11/1988 | Pryor | D6/405 X |
| 928,213 | 7/1909 | Patterson | 211/71 X |
| 1,043,387 | 11/1912 | Astruck | 211/196 X |
| 1,706,239 | 3/1929 | Leon | 248/159 |
| 1,747,951 | 2/1930 | Reichert | 211/33 X |
| 2,041,370 | 5/1936 | Pottorff | 248/159 |
| 2,447,924 | 8/1948 | Vitale | 211/205 |
| 4,770,303 | 9/1988 | Boyd | 211/205 |
| 4,991,344 | 2/1991 | Carney | 47/39 C |
| 5,037,049 | 8/1991 | Funk | D6/405 X |

*Primary Examiner*—Robert W. Gibson, Jr.

[57] ABSTRACT

An ornamental tree flower pot display is comprised of an upper support pipe formed as a hollow cylinder with openings at both ends. The pipe also includes coupling means located adjacent to both ends. A lower support bar is formed as a hollow cylinder with openings at both ends. The lower support bar has a smaller diameter and length than the upper support pipe and includes coupling means located adjacent to both ends. A joint is formed in a hollow, generally cylindrical configuration and includes an upper region and a lower region with openings at both ends. The upper region has a larger diameter than the lower region. The openings at both ends of the joint include coupling means to permit releasable coupling with the upper support pipe and lower support bar. A multi-unit branch ring consists of a center piece formed in a hollow, generally cylindrical configuration with openings at both ends. The center piece includes coupling means to permit releasable coupling with the upper support pipe. The center piece also includes a plurality of branch holders affixed to its perimeter. A plurality of branches are each formed as an elongated member with ends adapted to be positioned in the branch holder and suspend objects therefrom.

10 Claims, 4 Drawing Sheets

PRIOR ART

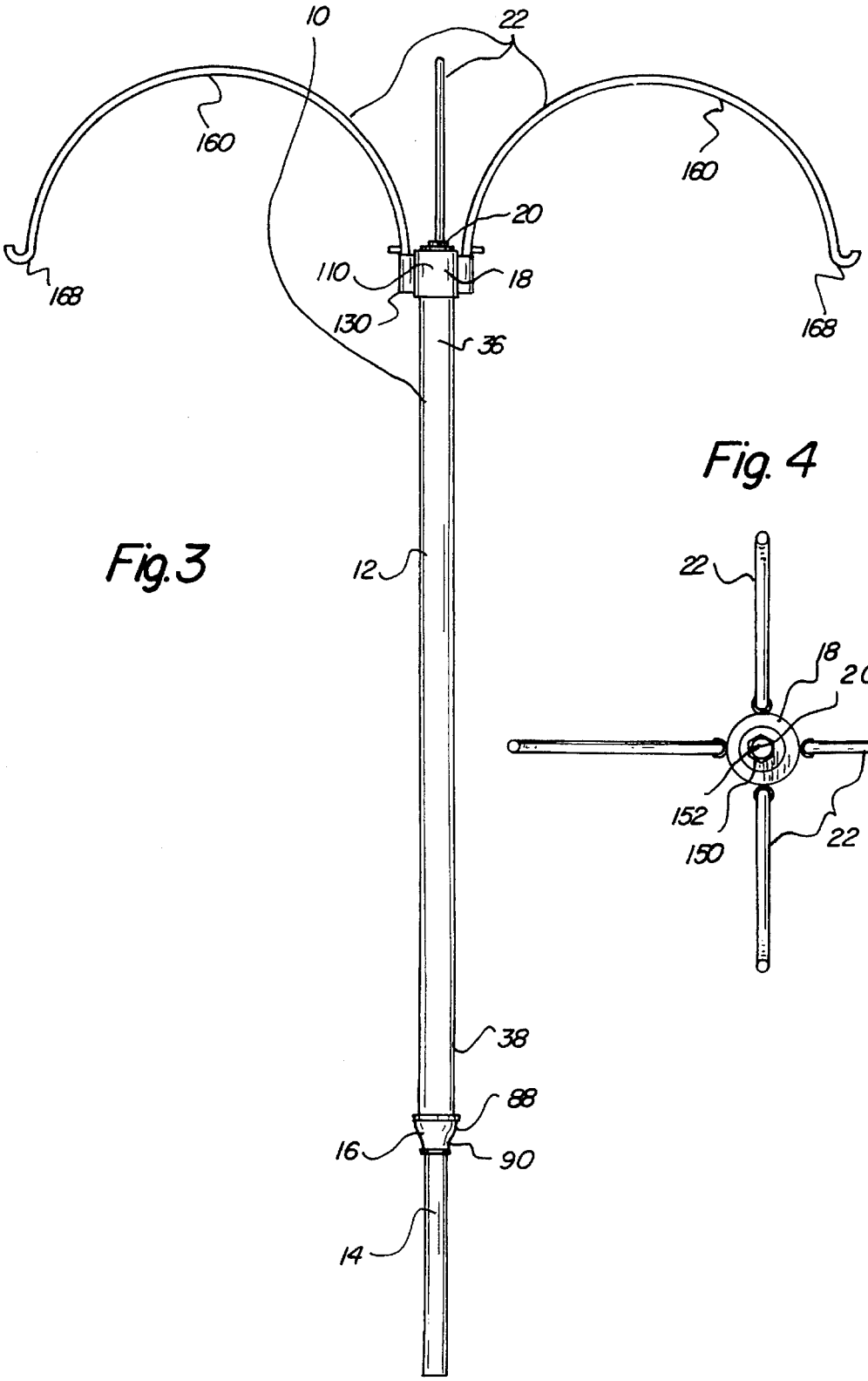
Fig. 3
Fig. 4
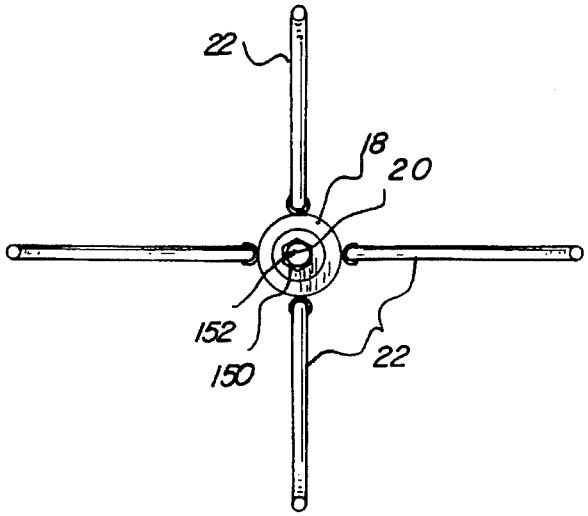

Fig. 5
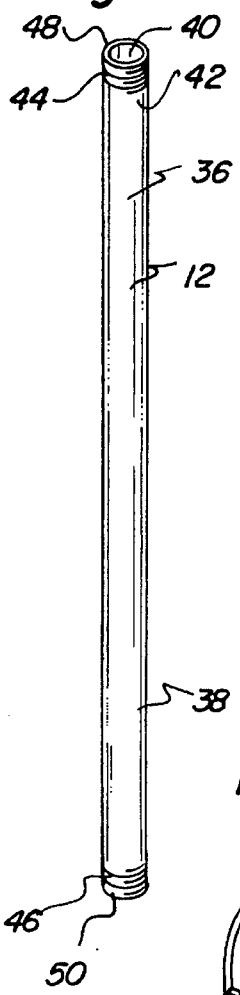
Fig. 6
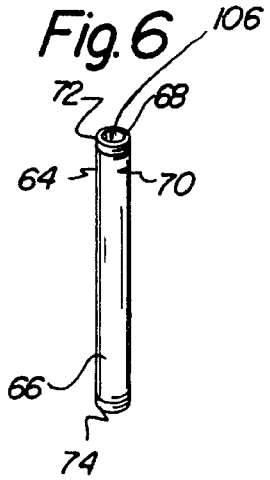
Fig. 7
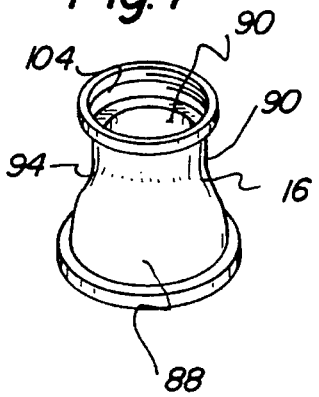
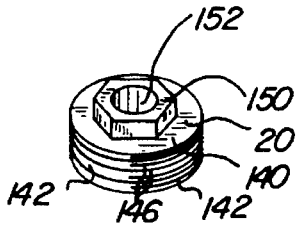
Fig. 9
Fig. 8
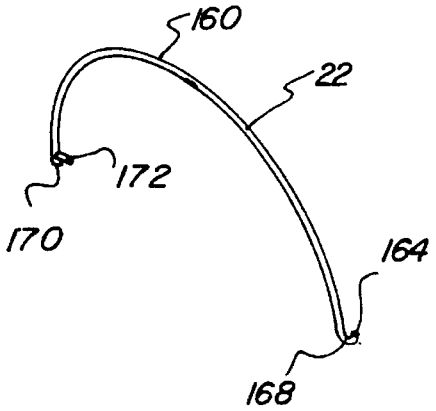
Fig. 10
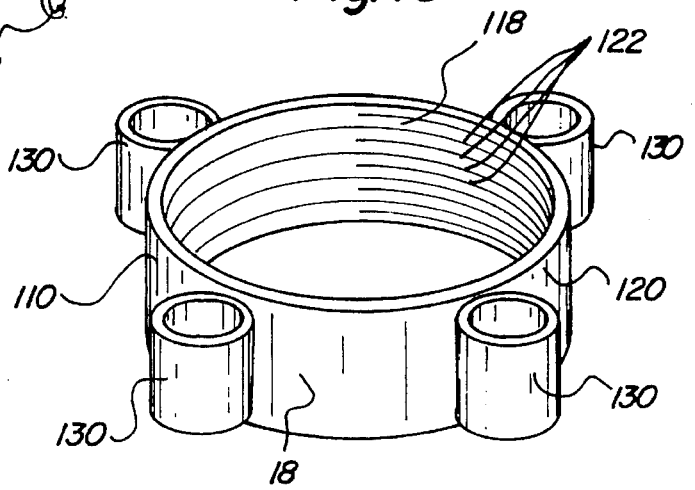

ORNAMENTAL TREE FLOWER POT DISPLAYS

BACKGROUND OF THE INVENTION

1. Field of the Invention

The present invention relates to ornamental tree flower pot displays and more particularly pertains to displaying potted flowers and plants from the symmetrically arranged branches of ornamental trees.

2. Description of the Prior Art

The use of tiered flower pot hangers is known in the prior art. More specifically, tiered flower pot hangers heretofore devised and utilized for the purpose of displaying potted plants in a vertically tiered configuration are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,603,507 to Nelson, a multi-tier multi-unit pot hanger assembly.

U.S. Pat. No. 4,349,172 to Banks, Jr. discloses a plant pot suspension apparatus and the like.

U.S. Pat. No. 4,941,283 to Armstrong discloses a support structure for multiple plants.

U.S. Pat. No. 4,691,473 to Ragen discloses a circular plant mobile.

Lastly, U.S. Pat. No. 3,957,242 to Holtz discloses a rotatable hanging device.

In this respect, the ornamental tree flower pot displays according to the present invention substantially departs from the conventional concepts and designs of the prior art, and in doing so provides an apparatus primarily developed for the purpose of displaying potted flowers and plants from the symmetrically arranged branches of ornamental trees.

Therefore, it can be appreciated that there exists a continuing need for new and improved ornamental tree flower pot displays which can be used for displaying potted flowers and plants from the symmetrically arranged branches of ornamental trees. In this regard, the present invention substantially fulfills this need.

SUMMARY OF THE INVENTION

In view of the foregoing disadvantages inherent in the known types of tiered flower pot hangers now present in the prior art, the present invention provides an improved ornamental tree flower pot displays. As such, the general purpose of the present invention, which will be described subsequently in greater detail, is to provide a new and improved ornamental tree flower pot displays and method which has all the advantages of the prior art and none of the disadvantages.

To attain this, the present invention essentially comprises a new and improved ornamental tree flower pot display including an upper support pipe comprised of metal and formed as a hollow cylinder with openings at both ends. The pipe has an upper end, a lower end, an inner surface, and an outer surface. The pipe also includes a plurality of external screw threads on the outer surface of its uppermost extent and lowermost extent. The pipe measures between about four feet and six feet and is adapted to be positioned vertically in the operative orientation. A lower support bar is comprised of metal and formed as a hollow cylinder with openings at both ends. The bar has an upper end, a lower end, an inner surface and an outer surface. The bar also includes a plurality of external screw threads on the outer surface of its uppermost extent and lowermost extent. The bar measures between about eighteen inches and thirty inches and is adapted to be positioned vertically in the operative orientation. The lower support bar has a smaller diameter than the upper support pipe. A joint is comprised of metal and formed in a hollow generally cylindrical configuration with openings at both ends. The joint has an upper region, a lower region, an inner surface, and an outer surface. The upper region and its corresponding opening have a larger diameter than the lower region and its corresponding opening. The opening in the upper region includes a plurality of internal screw threads on its inner surface to permit releasable coupling with the lowermost extent of the upper support pipe. The opening in the lower region includes a plurality of internal screw threads on its inner surface to permit releasable coupling with the uppermost extent of the lower support bar. A four unit branch ring is comprised of metal and includes a center piece formed in a hollow generally cylindrical configuration with openings at both ends. The center piece has an inner surface and an outer surface, with plurality of internal screw threads located throughout the entire extent of its inner surface. The center piece includes four equidistantly positioned metal branch holders affixed to its outer surface. The holders are formed in a hollow, generally cylindrical configuration with openings at both ends. Each holder has a small circumference and a length measuring between about sixty and eighty percent of the length of the center piece. The holders are centrally located on the center piece with their open ends positioned in unison with the open ends of the center piece. The ring is adapted to be coupled with the uppermost extent of the upper support pipe in the operative orientation. A ring cap is comprised of metal and formed in a planar generally cylindrical configuration. The cap has a flat upper surface and a flat lower surface with a cylindrically shaped side therebetween. The side includes a plurality of external screw threads throughout its extent to permit releasable coupling with the four unit branch ring. The upper surface has a generally hexagon shaped nut affixed to its central portion. The nut has a centrally located circular aperture extending therethrough. Four branches are each comprised of metal and formed as a long thin cylindrical member shaped in a generally semi-circular configuration. Each branch has two free ends, with a first free end terminating in an outwardly extending hook. A second free end terminates in a flat surface and includes a generally perpendicularly extending, cylindrically shaped projection located proximate to the flat surface. The projection is positioned to point toward the hook on the first free end of the branch when in the operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved ornamental tree flower pot displays which have all the advantages of the prior art tiered flower pot hangers and none of the disadvantages.

It is another object of the present invention to provide new and improved ornamental tree flower pot displays which may be easily and efficiently manufactured and marketed.

It is further object of the present invention to provide new and improved ornamental tree flower pot displays which are of durable and reliable constructions.

An even further object of the present invention is to provide new and improved ornamental tree flower pot displays which are susceptible of a low cost of manufacture with regard to both materials and labor, and which accordingly are then susceptible of low prices of sale to the consuming public, thereby making such ornamental tree flower pot displays economically available to the buying public.

Still yet another object of the present invention is to provide new and improved ornamental tree flower pot displays which provide in the apparatuses and methods of the prior art some of the advantages thereof, while simultaneously overcoming some of the disadvantages normally associated therewith.

Still another object of the present invention is to display potted flowers and plants from the symmetrically arranged branches of ornamental trees.

Lastly, it is an object of the present invention to provide new and improved ornamental tree flower pot displays comprised of an upper support pipe formed as a hollow cylinder with openings at both ends. The pipe also includes coupling means located adjacent to both ends. A lower support bar is formed as a hollow cylinder with openings at both ends. The lower support bar has a smaller diameter and length than the upper support pipe and includes coupling means located adjacent to both ends. A joint is formed in a hollow, generally cylindrical configuration and includes an upper region and a lower region with openings at both ends. The upper region has a larger diameter than the lower region. The openings at both ends of the joint include coupling means to permit releasable coupling with the upper support pipe and lower support bar. A multi-unit branch ring consists of a center piece formed in a hollow, generally cylindrical configuration with openings at both ends. The center piece includes coupling means to permit releasable coupling with the upper support pipe. The center piece also includes a plurality of branch holders affixed to its perimeter. A plurality of branches are each formed as an elongated member with ends adapted to be positioned in the branch holder and suspend objects therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the preferred embodiment of the ornamental tree flower pot display constructed in accordance with the principles of the present invention.

FIG. 4 is a top plan view of the flower pot display shown in FIG. 3.

FIG. 5 is a perspective view of the upper support pipe of the apparatus.

FIG. 6 is a perspective view of the lower support bar of the apparatus.

FIG. 7 is a perspective view of the joint which is adapted to couple the upper support pipe to the lower support bar.

FIG. 8 is a perspective view of one of the branches of the apparatus shown in FIG. 3.

FIG. 9 is a perspective view of the ring cap shown in FIG. 4.

FIG. 10 is a perspective view of the four branch ring shown in FIG. 3.

The same reference numerals refer to the same parts through the various Figures.

DESCRIPTION OF THE PREFERRED EMBODIMENT

Figure 1:
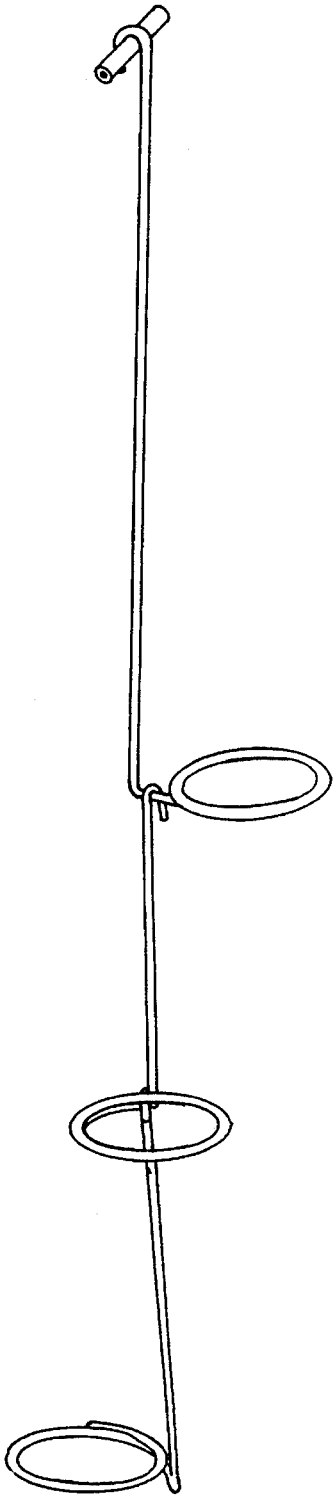
FIGS. 1 and 2 depict examples of prior art tiered flower pot hangers.
Figure 2:
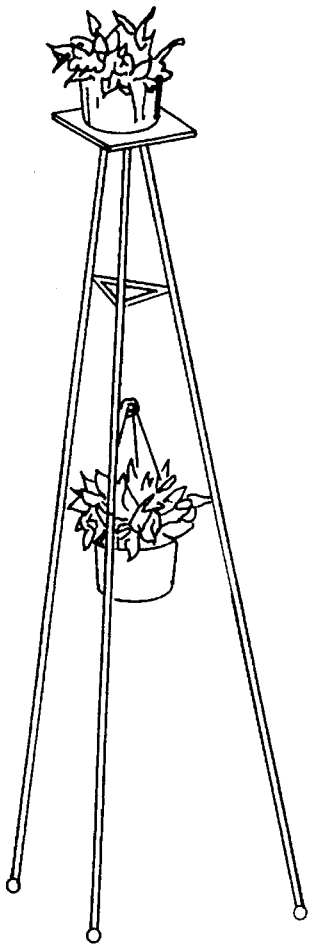
PRIOR ART Fig. 2

With reference now to the drawings, and in particular to FIG. 3 thereof, the preferred embodiment of the new and improved ornamental tree flower pot displays embodying the principles and concepts of the present invention and generally designated by the reference numeral 10 will be described.

Specifically, it will be noted in FIGS. 1 through 11, that there is provided a new and improved ornamental tree flower pot display. The flower pot display 10, in its broadest context, comprises an upper support pipe 12, a lower support bar 14, a joint 16, a four unit branch ring 18, a ring cap 20, and four branches 22.

More specifically, the upper support pipe 12 is comprised of metal and formed as a hollow cylinder with openings at both ends. The pipe 12 has an upper end 36, a lower end 38, an inner surface 40, and an outer surface 42. The pipe 12 also includes a plurality of external screw threads 44, 46 on the outer surface of its uppermost extent 48 and lowermost extent 50. The pipe 12 measures between about four feet and six feet and is adapted to be positioned vertically in the operative orientation. Note FIG. 5.

A lower support bar 14 is comprised of metal and formed as a hollow cylinder with openings at both ends. The bar 14 has an upper end 64, a lower end 66, an inner surface 68 and an outer surface 70. The bar 14 also includes a plurality of external screw threads 72, 74 on the outer surface of its uppermost extent and lowermost extent. The bar 14 measures between about eighteen inches and thirty inches and is adapted to be positioned vertically in the operative orientation. The lower support bar 14 has a smaller diameter than the upper support pipe 12. Note FIG. 6.

A joint 16 is comprised of metal and formed in a hollow generally cylindrical configuration with openings at both ends. The joint 16 has an upper region 88, a lower region 90, an inner surface 92, and an outer surface 94. The upper region 88 and its corresponding opening 84 have a larger diameter than the lower region 90 and its corresponding opening. The opening 84 in the upper region includes a plurality of internal screw threads 100 on its inner surface to permit releasable coupling with the lowermost extent 50 of the upper support pipe 12. The opening in the lower region includes a plurality of internal screw threads 104 on its inner surface to permit releasable coupling with the uppermost extent 106 of the lower support bar 14. The joint serves to couple the lower support bar to the upper support pipe. The lower support pipe is positioned directly below the upper support bar in the operative orientation, with both components standing vertically. The lower end of the lower support bar may be inserted directly into soil as a means of support for the apparatus. Note FIG. 7.

A four unit branch ring 18 is comprised of metal and includes a center piece 110 formed in a hollow generally cylindrical configuration with openings at both ends. The center piece 110 has an inner surface 118 and an outer surface 120, with plurality of internal screw threads 122 located throughout the entire extent of its inner surface 118. The center piece 110 includes four equidistantly positioned metal branch holders 130 affixed to its outer surface. The holders 130 are formed in a hollow, generally cylindrical configuration with openings at both ends. Each holder 130 has a small circumference and a length measuring between about sixty and eighty percent of the length of the center piece 110. The holders 130 are centrally located on the center piece 110 with their open ends positioned in unison with the open ends of the center piece. The ring 18 is adapted to be coupled with the uppermost extent 48 of the upper support pipe 12 in the operative orientation. Note FIG. 10.

A ring cap 20 is comprised of metal and formed in a planar generally cylindrical configuration. The cap 20 has a flat upper surface 140 and a flat lower surface 142 with a cylindrically shaped side 144 therebetween. The side 144 includes a plurality of external screw threads 146 throughout its extent to permit releasable coupling with the four unit branch ring 18. The upper surface 140 has a generally hexagon shaped nut 150 affixed to its central portion. The nut 150 has a centrally located circular aperture 152 extending therethrough. The ring cap prevents rain and other undesirable materials from entering the hollow interior of the branch ring and upper support pipe. Note FIG. 9.

Four branches 22 are each comprised of metal and formed as a long thin cylindrical member 160 shaped in a generally semicircular configuration. Each branch 22 has two free ends 164, 166, with a first free end 164 terminating in an outwardly extending hook 168. A second free end 166 terminates in a flat surface 170 and includes a generally perpendicularly extending, cylindrically shaped projection 172 located proximate to the flat surface 170. The projection 172 is positioned to point toward the hook 168 on the first free end 164 of the branch 22 when in the operative orientation. The user inserts the hook end of the branch into the branch holder if he desires a downwardly looping branch. Alternatively, the user inserts the other end of the branch into the branch holder if he desires an upwardly looping branch. Note FIG. 8.

The ornamental tree flower pot display resembles a tree with symmetrical steel branches. It is used for displaying flowers, attractive plants, or bird feeders. It is similar in appearance to an ornamental tree and includes a trunk with four equally spaced branches extending from the top of the trunk. The tree is made entirely of steel. The trunk of the ornamental tree consists of one length of pipe measuring between four and six feet, and another measuring between eighteen inches and thirty inches. Both trunk components include screw threads near their ends.

The trunk is assembled by coupling the trunk components with a joint. The branch ring is then coupled to the upper end of the upper support bar and the ring cap is positioned within the branch ring. The branches are then placed in the branch holders to complete the assembly process. The user inserts the hook end of the branch into the branch holder if he desires a downwardly looping branch. Alternatively, the user inserts the other end of the branch into the branch holder if he desires an upwardly looping branch. When fully assembled, the user has a very attractive ornamental tree flower pot display. The apparatus would be a handsome addition to any home, restaurant, or other place of business.

Figure 11:
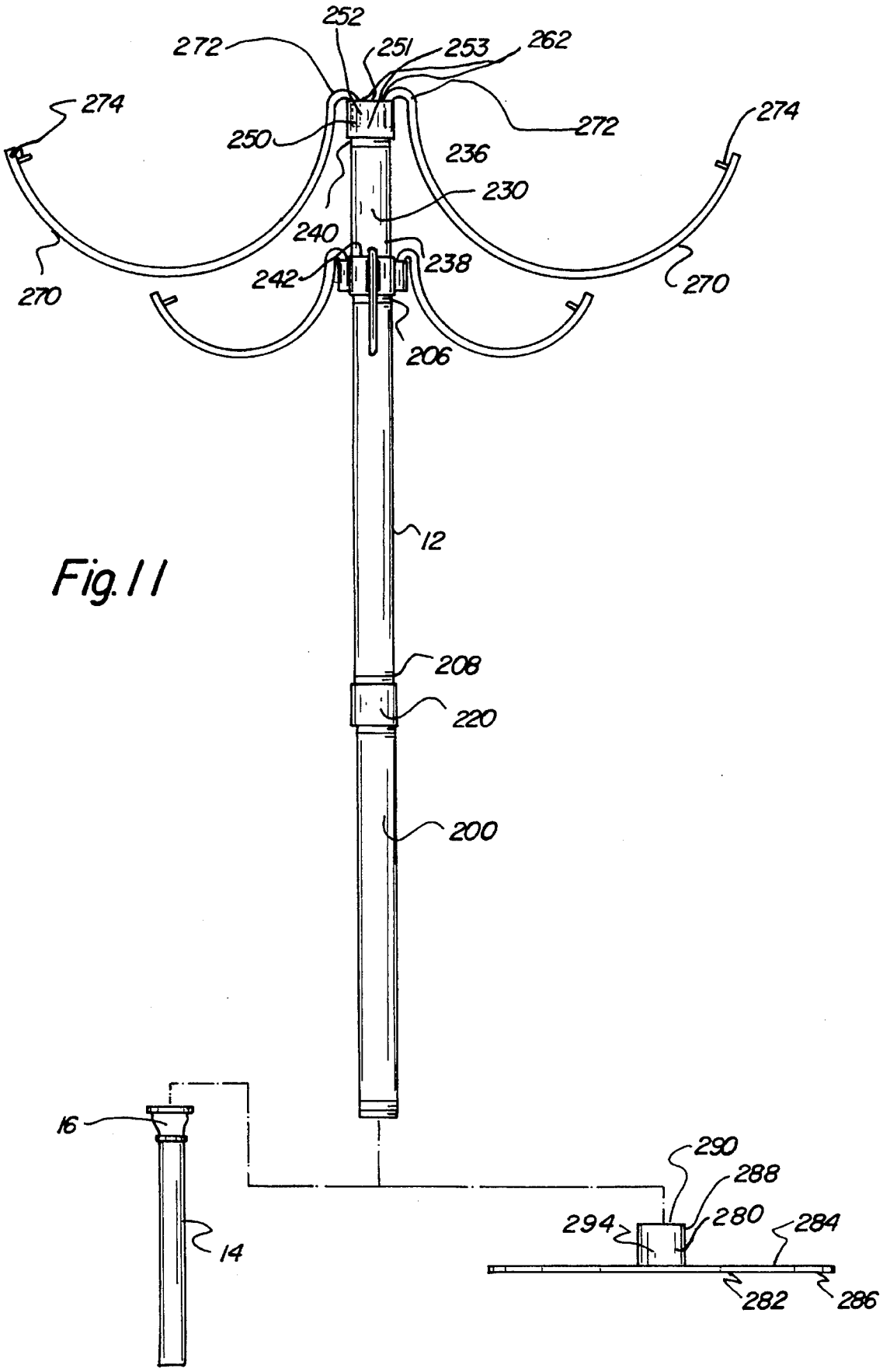
FIG. 11 is a perspective view of an alternative embodiment of the ornamental tree flower pot display.

An alternative embodiment of the invention is shown in FIG. 11. This embodiment incorporates all of the components of the primary embodiment except for the ring cap 20. In addition, the alternative embodiment includes the components as described below.

An intermediate support bar 200 is positioned between the upper support pipe 12 and the lower support bar 14. The intermediate support bar 200 is formed as a hollow cylinder with openings at both ends and includes coupling means located adjacent to both ends 206, 208.

A joint 212 is adapted to couple the intermediate support bar 200 to the lower support bar 14.

A connector piece 220 is formed in a hollow generally cylindrical configuration with openings at both ends. The openings include coupling means to permit releasable coupling of the upper support pipe 12 to the intermediate support bar 200.

An extension pipe 230 is formed as a hollow cylinder with openings at both ends. The extension pipe has an upper region 236 and a lower region 238 and includes coupling means 240, 242 located adjacent to its open ends. The extension pipe 230 is adapted to be positioned vertically in the operative orientation with its lowermost end coupled with multi-unit branch ring.

A two unit branch ring 250 consists of a center piece 252 formed in a hollow generally cylindrical configuration with an inner surface 251 and an outer surface 253 and openings at both ends. The center piece 252 includes coupling means 258, 260 to permit releasable coupling with the extension pipe 230. The center piece 252 also includes two branch holders 262 affixed to the opposite ends of the perimeter of its inner surface 251.

Two upper branches 270 are each formed as an elongated member with ends 272, 274 adapted to be positioned in the branch holders 262 located on the inner surface 251 of the two unit branch ring 250 and also suspend objects therefrom. The upper branches 270 have a length approximately twice that of the branches 22 located in the multi-branch ring.

A patio base 280 is adapted to be coupled with the lowermost extent of the lower support bar 14. The base 280 has a generally planar, circular bottom segment 282 with an upper face 284 and a lower face 286. The upper face 284 includes a centrally located upwardly extending, hollow generally cylindrical shaped component 288 with an opening 290 at its uppermost extent. The cylindrical shaped component 288 has an inner surface 292 and an outer surface 294, with the inner surface 292 including a plurality of internal screw threads 296 adapted to permit coupling with the lower support bar 14.

The alternative embodiment of the invention adds an extra tier of branches, an extra trunk segment and a patio stand. This embodiment may be preferred by users who owns many potted plants or live in condominium or townhouses with small patios or balconies. Assembly is similar to the method described for the primary embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ornamental tree flower pot display comprising, in combination:

an upper support pipe comprised of metal and formed as a hollow cylinder with openings at both ends, the pipe having an upper end and a lower end and an inner surface and an outer surface, the pipe also including a plurality of external screw threads on the outer surface of its uppermost extent and lowermost extent, with the pipe adapted to be positioned vertically in the operative orientation with a length measuring between about four feet and six feet;

a lower support bar comprised of metal and formed as a hollow cylinder with openings at both ends, the bar having an upper end and a lower end and an inner surface and an outer surface, the bar also including a plurality of external screw threads on the outer surface of its upper most extent and lowermost extent, with the bar adapted to be positioned vertically in the operative orientation with a length measuring between about eighteen inches and thirty inches, with the lower support bar having a smaller diameter than the upper support pipe;

a joint comprised of metal and formed in a hollow generally cylindrical configuration with openings at both ends, the joint having an upper region and a lower region and an inner surface and an outer surface, with the upper region and its corresponding opening having a larger diameter than the lower region and its corresponding opening, with the opening in the upper region including a plurality of internal screw threads on its inner surface to permit releasable coupling with the lowermost extent of the upper support pipe, with the opening in the lower region including a plurality of internal screw threads on its inner surface to permit releasable coupling with the uppermost extent of the lower support bar;

a four unit branch ring comprised of metal and including a center piece formed in a hollow generally cylindrical configuration with openings at both ends, the center piece having an inner surface and an outer surfaced with a plurality of internal screw threads throughout the entire extent of its inner surface, the center piece including four equidistantly positioned metal branch holders affixed to its outer surface, the holders being formed in a hollow generally cylindrical configuration with openings at both ends, each holder having a small circumference and a length measuring between about sixty and eighty percent of the length of the center piece, the holders being centrally located on the center piece with their open ends positioned in unison with the open ends of the center piece, the ring adapted to be coupled with the uppermost extent of the upper support pipe in the operative orientation;

a ring cap comprised of metal and formed in a planar generally cylindrical configuration, the cap having a flat upper surface and a flat lower surface with a cylindrically shaped side therebetween, the side including a plurality of external screw threads throughout its extent to permit releasable coupling with the four unit branch ring, the upper surface having a generally hexagon shaped nut affixed to its central portion, the nut including a centrally located circular aperture extending therethrough; and four branches, each branch being comprised of metal and formed as a long thin cylindrical member shaped in a generally semi-circular configuration, each branch having two free ends, a first free end terminating in an outwardly extending hook, a second free end terminating in a flat surface and includes a generally perpendicularly extending cylindrically shaped projection located proximate to the flat surface, each end of each branch capable of being inserted into one of the four branch holders of the branch ring when the ring being coupled to the upper support pipe is in the operative orientation, the projection being positioned to point toward the hook on the first free end of the branch when in the operative orientation.

2. An ornamental tree flower pot display comprising:

an upper support pipe formed as a hollow cylinder with openings at both ends, the pipe also including coupling means located adjacent to both ends;

a lower support bar formed as a hollow cylinder with openings at both ends, with the lower support bar having a smaller diameter and length than the upper support pipe and including coupling means located adjacent to both ends;

a joint formed in a hollow generally cylindrical configuration with an upper region and a lower region and openings at both ends, the upper region having a larger diameter than the lower region, with the openings at both ends of the joint including coupling means to permit releasable coupling with the upper support pipe and lower support bar;

a multi-unit branch ring consisting of a center piece formed in a hollow generally cylindrical configuration with openings at both ends, the center piece including coupling means to permit releasable coupling with the upper support pipe, the center piece including a plurality of branch holders affixed to its perimeter; and a plurality of branches, each branch being formed as an elongated member with ends adapted to be positioned in the branch holder and suspend an object therefrom.

3. The flower pot display as set forth in claim 2 and further including:

a ring cap formed in a planar generally cylindrical configuration, the cap having an upper surface and a lower surface, the cap including coupling means to permit releasable coupling with the multi-unit branch ring.

4. The flower pot display as set forth in claim 2 and further including:

an intermediate support bar positioned between the upper support pipe and the lower support bar, the intermediate support bar formed as a hollow cylinder with openings at both ends and including coupling means located adjacent to both ends.

5. The flower pot display as set forth in claim 4 wherein the joint is adapted to couple with the intermediate support bar and the lower support bar.

6. The flower pot display as set forth in claim 5 and further including:

a connecter piece formed in a hollow generally cylindrical configuration with openings at both ends, with the openings at both ends including coupling means to permit releasable coupling with the upper support pipe and intermediate support bar.

7. The flower pot display as set forth in claim 6 and further including:

an extension pipe formed as a hollow cylinder with openings at both ends, the extension pipe having an upper region and a lower region and including coupling means located adjacent to the open ends, the extension pipe adapted to be positioned vertically in the operative orientation with its lowermost end coupled with multi-unit branch ring.

8. The flower pot display as set forth in claim 7 and further including:

a two unit branch ring consisting of a center piece formed in a hollow generally cylindrical configuration with an inner surface and an outer surface and openings at both ends, the center piece including coupling means to permit releasable coupling with the extension pipe, the center piece including two branch holders affixed to opposite ends of the perimeter of its inner surface.

9. The flower pot display as set forth in claim 8 and further including:

two upper branches, each branch being formed as an elongated member with ends adapted to be positioned in the branch holders located on the inner surface of the two unit branch ring and also to suspend an object therefrom, the upper branches having a length approximately twice that of the branches located in the multi-branch ring.

10. The flower pot display as set forth in claim 9 and wherein the lowermost extent of the lower support bar further includes a patio base, the base having a generally planar circular bottom segment with an upper face and a lower face, the upper face including a centrally located upwardly extending, hollow generally cylindrical shaped component with an opening at its uppermost extent, the cylindrical shaped component having an inner surface and an outer surface with the inner surface including a plurality of internal screw threads adapted to permit coupling with the lower support bar.

* * * * *